US011867405B2

(12) United States Patent
Auer et al.

(10) Patent No.: US 11,867,405 B2
(45) Date of Patent: Jan. 9, 2024

(54) FLEXIBLE BRACKET FOR A COOKING APPLIANCE

(71) Applicant: WHIRLPOOL CORPORATION, Benton Harbor, MI (US)

(72) Inventors: Alexander R. Auer, Benton Harbor, MI (US); Flavio Silvio Gava, Joinville (BR); Dhiraj Jambuvant Gotekar, Maharashtra (IN); Amit Mandal, Maharashtra (IN); Manan Panchal, Maharashtra (IN)

(73) Assignee: Whirlpool Corporation, Benton Harbor, MI (US)

( * ) Notice: Subject to any disclaimer, the term of this patent is extended or adjusted under 35 U.S.C. 154(b) by 47 days.

(21) Appl. No.: 17/106,545

(22) Filed: Nov. 30, 2020

(65) Prior Publication Data

US 2022/0170645 A1 Jun. 2, 2022

(51) Int. Cl.
*F24C 15/08* (2006.01)

(52) U.S. Cl.
CPC ..... *F24C 15/08* (2013.01)

(58) Field of Classification Search
CPC ..... F24C 15/08
See application file for complete search history.

(56) References Cited

U.S. PATENT DOCUMENTS 2,434,811 A * 1/1948 Rogers ..... F24C 15/08 126/39 B
3,038,462 A * 6/1962 Bohdan ..... F24C 14/02 49/475.1
3,131,684 A * 5/1964 More ..... F24C 15/021 126/19 R
3,385,280 A * 5/1968 Schmahl ..... F24C 15/08 220/592.2

(Continued)

FOREIGN PATENT DOCUMENTS

CA 2780642 A1 * 11/2013 ..... F24C 15/04
CA 2782354 A1 * 11/2013 ..... F24C 15/04

(Continued)

OTHER PUBLICATIONS

US 3,695,584 A1, 04/2014, Boeckler et al. (withdrawn)

*Primary Examiner* — Hanh V Tran
(74) *Attorney, Agent, or Firm* — Price Heneveld LLP

(57) ABSTRACT

A bracket for a cooking appliance includes first and second mounting members that are spaced-apart to define a gap therebetween. First and second connecting members span the gap between the first and second mounting members, and each include a first portion coupled to the first mounting member, a second portion coupled to the second mounting member and an intermediate portion disposed therebetween. The first and second portions of the first connecting member are coupled to opposite ends of the intermediate portion of the first connecting member at first and second deflection creases, respectively. The first and second portions of the (Continued)

second connecting member are coupled to opposite ends of the intermediate portion of the second connecting member at first and second deflection creases, respectively. The first and second connecting members are configured to flex between at-rest and loaded conditions as the bracket moves between at-rest and contracted positions.

13 Claims, 4 Drawing Sheets

(56) References Cited

U.S. PATENT DOCUMENTS 3,636,766 A * 1/1972 Austin ..... G01P 5/02 73/861.75
4,161,939 A * 7/1979 Scherer ..... F24C 15/08 126/39 M
4,651,959 A * 3/1987 Bolton ..... F24F 13/32 62/262
4,848,311 A * 7/1989 Dorri ..... F24C 15/08 126/21 R
5,763,857 A 6/1998 Klement et al.
6,830,299 B2 * 12/2004 Henriott ..... E05D 15/0678 312/139.2
2007/0175885 A1 * 8/2007 Brower ..... F24C 15/08 219/401
2007/0246038 A1 * 10/2007 Raby ..... F24C 15/08 126/273 R
2013/0319396 A1 * 12/2013 DeLozier ..... F24C 15/04 126/200
2013/0319397 A1 * 12/2013 Braden ..... F24C 15/04 126/200
2014/0150768 A1 * 6/2014 Ingersoll ..... F24C 15/08 126/19 R
2016/0195281 A1 * 7/2016 Chaturvedi ..... F24C 15/18 219/393
2018/0274282 A1 * 9/2018 Nelson ..... F24C 15/08
2019/0101293 A1 * 4/2019 Kim ..... F24C 15/108
2020/0033009 A1 * 1/2020 Lee ..... A47J 27/12

FOREIGN PATENT DOCUMENTS

CN 201830367 U * 5/2011
CN 210864835 U * 6/2020
DE 7105443 U 11/1971
DE 102013207358 A1 * 10/2014 ..... H01M 2/202
EP 1464895 A1 10/2004
FR 2853955 A1 10/2004
KR 20060086012 A 7/2006
WO 2007088078 A1 8/2007

* cited by examiner

FLEXIBLE BRACKET FOR A COOKING APPLIANCE

BACKGROUND OF THE DISCLOSURE

The present disclosure generally relates to a bracket for a cooking appliance, and more specifically, to a flexible bracket configured to absorb the dimensional changes of a cooking vessel during a cooking procedure.

SUMMARY OF THE DISCLOSURE

According to another aspect of the present disclosure, a cooking appliance includes a support frame and a cooking vessel that is spaced-apart from the support frame to define a spacing therebetween. The cooking vessel is operable between at-rest and expanded conditions. An outer surface of the cooking vessel approaches the support frame when the cooking vessel moves from the at-rest condition to the expanded condition. A bracket interconnects the support frame and the cooking vessel. The bracket includes a first mounting member operably coupled to the cooking vessel and a second mounting member operably coupled to the support frame. At least one flexibly resilient connecting member interconnects the first and second mounting members and spans the spacing between the support frame and the cooking vessel.

According to another aspect of the present disclosure, a bracket for a cooking appliance includes a first mounting member spaced-apart from a second mounting member to define a gap therebetween. A first connecting member spans the gap between the first and second mounting members. The first connecting member includes a first portion coupled to the first mounting member, second portion coupled to the second mounting member, and an intermediate portion disposed therebetween. The first and second portions of the first connecting member are coupled to opposite ends of the intermediate portion at first and second deflection creases, respectively. A second connecting member spans the gap between the first and second mounting members and includes a first portion that is coupled to the first mounting member, a second portion coupled to the second mounting member, and an intermediate portion disposed therebetween. The first and second portions of the second connecting member are coupled to opposite ends of the intermediate portion at first and second deflection creases, respectively According to yet another aspect of the present disclosure, a bracket for a cooking appliance includes a first mounting member and a second mounting member spaced-apart from the first mounting member to define a gap having a length disposed therebetween. At least one connecting member interconnects the first and second mounting members. The at least one connecting member includes at least one deflection crease and is operable between at-rest and loaded conditions. The length of the gap decreases as the at least one connecting member moves from the at-rest condition to the loaded condition.

These and other features, advantages, and objects of the present disclosure will be further understood and appreciated by those skilled in the art by reference to the following specification, claims, and appended drawings.

Figure 1:
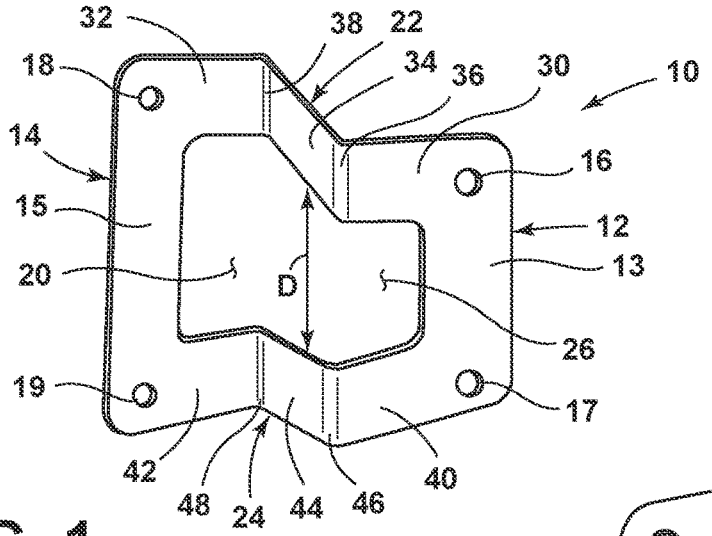
FIG. 1 is a top perspective view of a bracket of the present concept.

The components in the figures are not necessarily to scale, emphasis instead being placed upon illustrating the principles described herein.

DETAILED DESCRIPTION

The present illustrated embodiments reside primarily in combinations of method steps and apparatus components related to a flexible bracket for cooking appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Figure 2:
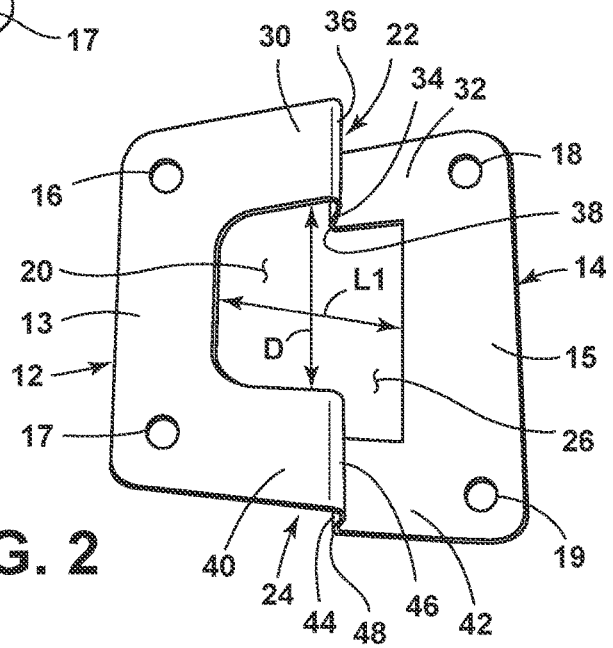
FIG. 2 is a bottom perspective view of the bracket of FIG. 1.

Referring now to FIGS. 1 and 2, a bracket 10 is shown having a first mounting member 12 and a second mounting member 14. The first mounting member 12 and the second mounting member 14 are spaced-apart from one another to define a gap 20 therebetween. Specifically, the first mounting member 12 is both vertically and horizontally offset from the second mounting member 14 by first and second connecting members 22, 24 which span the gap 20 to interconnect the first and second mounting members 12, 14, as further described below. The first mounting member 12 includes a generally planar body portion 13 having upper and lower mounting apertures 16, 17 disposed therethrough. Similarly, the second mounting member 14 includes a generally planar body portion 15 having upper and lower mounting apertures 18, 19 disposed therethrough.

Figure 4:
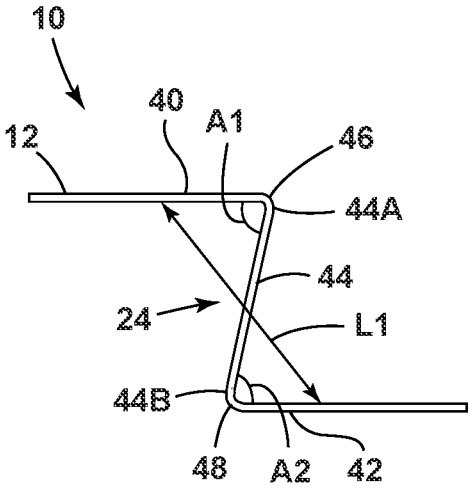
FIG. 4 is a side elevation view of the bracket of FIG. 1.
Figure 5:
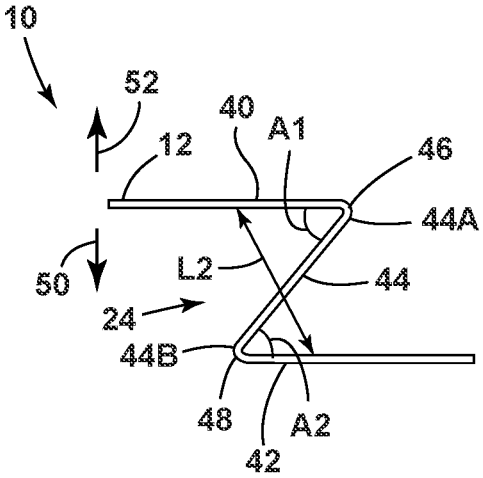
FIG. 5 is a side elevation view of the bracket FIG. 4 showing the bracket in a contracted position.

The first and second connecting members 22, 24 may be referred to herein as upper and lower connecting members. It is also contemplated that the bracket 10 may include a single connecting member, or more than two connecting members in various embodiments. In the embodiment shown in FIGS. 1 and 2, the first connecting member 22 includes a first portion 30 and a second portion 32 which are interconnected by an intermediate portion 34 at first and second deflection creases 36, 38, respectively. Similarly, the second connecting member 24 includes a first portion 40 and a second portion 42 which are interconnected by an intermediate portion 44 at first and second deflection creases 46, 48, respectively. In this way, the first and second connecting members 22, 24 are non-linear members which include a generally Z-shaped configuration in the illustrated embodiment. As used herein, the term "deflection crease" is meant to indicate a bend in a portion of the bracket 10, wherein an angle is provided therebetween. The bend provided by the first and second deflection creases 36, 38 and 46, 48 of the present concept directs the location of contraction of the bracket 10. Thus, the first and second connecting members 22, 24 are contemplated to be flexibly resilient members configured to flex at the first and second deflection creases 36, 38 and 46, 48, respectively. Specifically, the first and second connecting members 22, 24 are contemplated to inwardly flex at the respective first and second deflection creases 36, 38 and 46, 48, such that the first and second connecting members 22, 24 are operable between at-rest and loaded conditions. In this way, the bracket 10 is operable between at-rest and contracted positions, wherein the first and second mounting members 12, 14 approach one another to decrease a length L of the gap 20, as best shown in FIGS. 4 and 5, as the bracket 10 moves from the at-rest position to the contracted position and the first and second connecting members 22, 24 move from the at-rest condition to the loaded condition. In the embodiment shown in FIGS. 1 and 2, the first and second connecting members 22, 24 are vertically spaced-apart a distance D to define a thermal break 26 therebetween.

Figure 3:
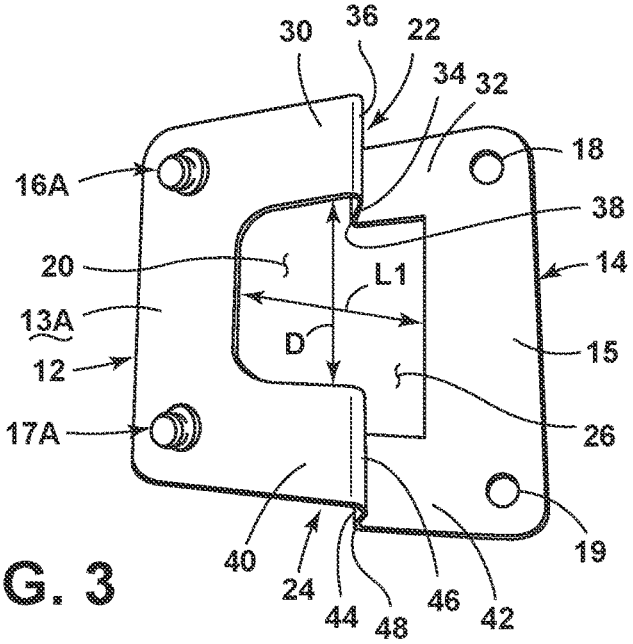
FIG. 3 is a top perspective view of a bracket according to another embodiment of the present concept.

Referring now to FIG. 3, another embodiment of the bracket 10A is shown, wherein the upper and lower mounting apertures 16, 17 (FIGS. 1 and 2) of the first mounting member 12 have been replaced by upper and lower mounting bosses 16A, 17A. As shown in FIG. 3, the upper and lower mounting bosses 16A, 17A outwardly extend from an upper surface 13A of the planar body portion 13 of the first mounting member 12. It is contemplated that the upper and lower mounting bosses 16A, 17A may be received in reciprocal mounting apertures disposed on a cooking vessel, as further described below.

Figure 6:
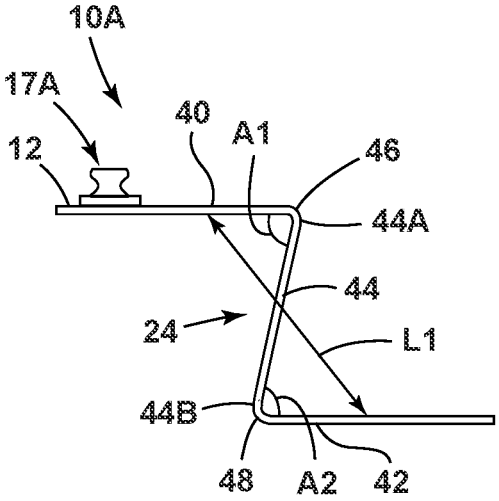
FIG. 6 is a side elevation view of the bracket of FIG. 3.
Figure 7:
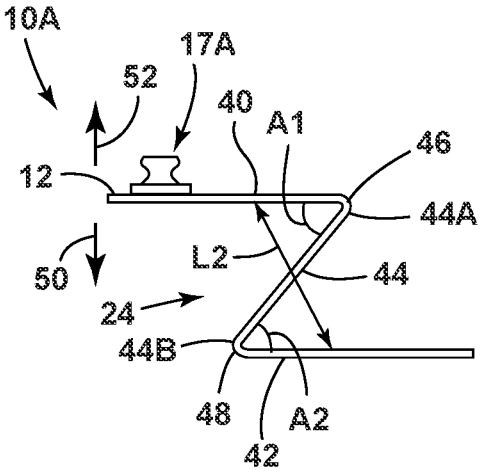
FIG. 7 is a side elevation view of the bracket FIG. 6 showing the bracket in a contracted position.

Referring now to FIG. 4, the bracket 10 is shown in the at-rest position, wherein the gap 20 defined between the first and second mounting members 12, 14 includes an at-rest length L1. Referring now to FIG. 5, the bracket 10 is shown in the contracted position, wherein the gap 20 defined between the first and second mounting members 12, 14 includes a contracted length L2. Thus, when the bracket 10 is in the contracted position, the length L of gap 20 decreases from the at-rest length L1 to the contracted length L2. Said differently, the length L of the gap 20 is greater when the bracket 10 is in the at-rest position as comparted to the contracted position. In this way, the bracket 10 is a flexible bracket which is contemplated to be biased towards the at-rest position shown in FIG. 4. The resiliency of the bracket 10 is provided by the first and second connecting members 22, 24, as the first and second connecting members 22, 24 are flexibly resilient between the at-rest and loaded conditions. In the loaded conditions, the first and second connecting members 22, 24 store a spring force that biases the bracket 10 to the at-rest position. The contraction of the bracket 10A is also shown in a similar manner in FIGS. 6 and 7.

With further reference to FIGS. 4 and 5, the bracket 10 is configured to flex or bend at the predetermined positions of the first and second deflection creases 36, 38 and 46, 48 of the first and second connecting members 22, 24. In the side elevation view of FIGS. 4 and 5, only the second connecting member 24 is shown, however, it is contemplated that the first connecting member 22 flexes in a similar manner as described below. As shown in FIGS. 4 and 5, the second connecting member 24 includes the intermediate portion 44 having opposed first and second ends 44A, 44B. The first deflection crease 46 interconnects the first portion 40 of the second connecting member 24 with the intermediate portion 44 of the second connecting member 24 at the first end 44A thereof. In this way, a first angle A1 is defined at the first deflection crease 46 between the first portion 40 and intermediate portion 44 of the second connecting member 24. The second deflection crease 48 interconnects the second portion 42 of the second connecting member 24 with the intermediate portion 44 of the second connecting member 24 at the second end 44B thereof. In this way, a second angle A2 is defined at the second deflection crease 48 between the second portion 42 and intermediate portion 44 of the second connecting member 24.

With specific reference to FIG. 4, the bracket 10 is shown in the at-rest position. In moving the bracket 10 from the at-rest position to the contracted position as the first and second connecting members 22, 24 move from the at-rest condition to the loaded condition, shown in FIG. 5, the first mounting member 12 of the bracket 10 moves in the direction as indicated by arrow 50 towards the second mounting member 14 to decrease the gap 20 therebetween. The first mounting member 12 moves towards the second mounting member 14 in response to an expansion force of a cooking cavity acting on the first mounting member 12, as further described below. As noted above, the bracket 10 is biased towards the at-rest position, such that the first mounting member 12 moves away from the second mounting member 14, and the direction as indicated by arrow 52, as the imparting force is lessoned or removed from the first mounting member 12. As the bracket 10 moves from the at-rest position, shown in FIG. 4, to the contracted position, shown in FIG. 5, the first and second angles A1, A2 decrease, thereby accounting for, or otherwise absorbing, the movement of the first mounting member 12. It is contemplated that the second mounting member 14 may be a stationary member as mounted to a support frame, as further described below.

Figure 8:
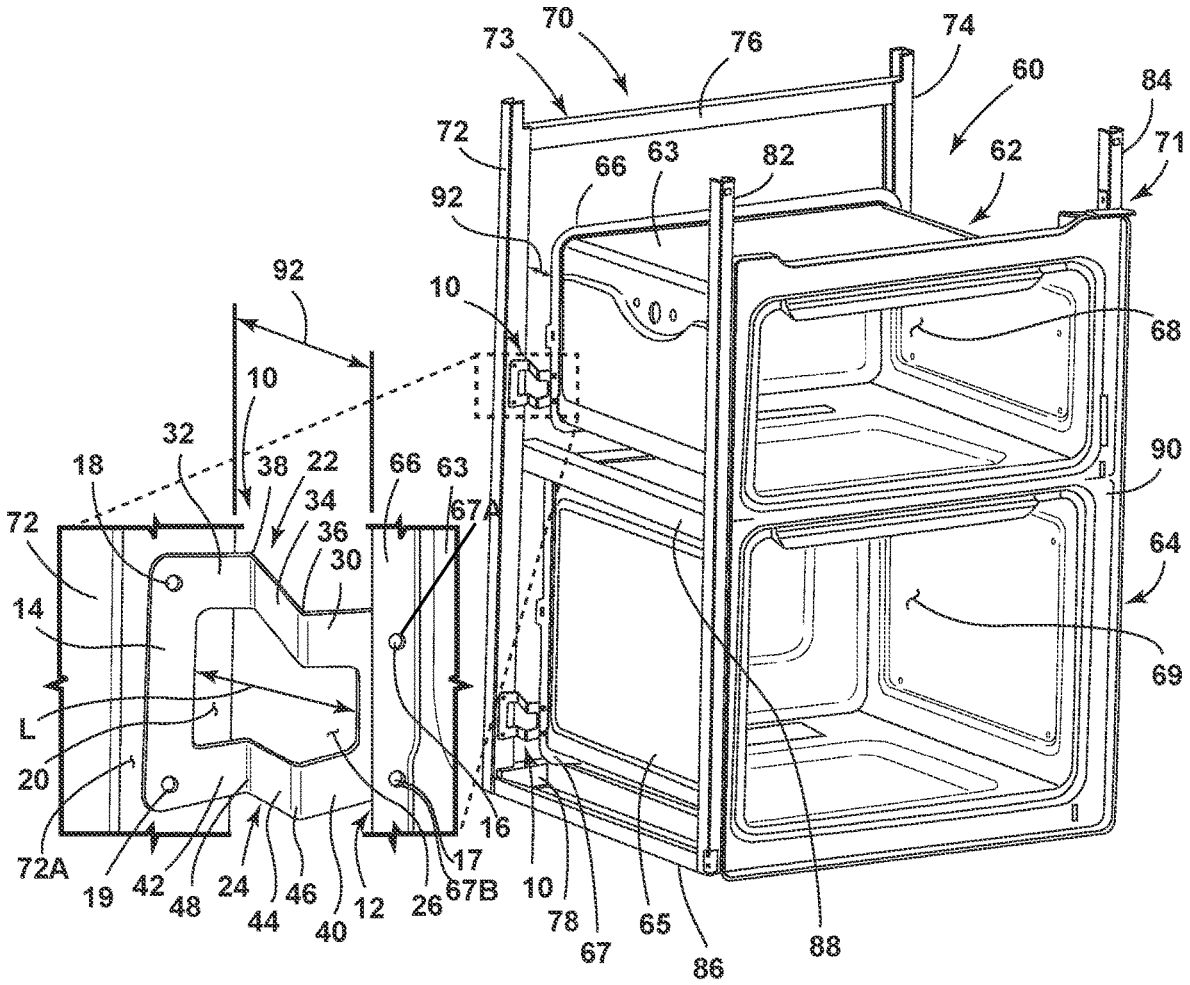
FIG. 8 is a front top perspective view of a cooking appliance and a support frame interconnected by the bracket of FIG. 1.

Referring now to FIG. 8, a cooking appliance 60 is shown having upper and lower cooking vessels 62, 64. It is contemplated that the cooking appliance 60 may include a dual oven configuration, or a microwave and oven combination. The upper cooking vessel 62 includes an outer surface 63 surrounding a cooking cavity 68. A rear mounting plate 66 is shown on a rear portion of the upper cooking vessel 62, and is contemplated to be part of the outer surface 63 of the upper cooking vessel 62. Similarly, the lower cooking vessel 64 includes an outer surface 65 that surrounds a cooking cavity 69. A rear mounting plate 67 is shown on a rear portion of the lower cooking vessel 64, and is contemplated to be part of the outer surface 65 of the lower cooking vessel 64. The cooking cavities 68, 69 of the respective cooking vessels 62, 64 are contemplated to be heated to desired cooking temperatures for cooking food item therein. As the cooking cavities 68, 69 are heated, the outer surfaces 63, 65 of the respective cooking vessels 62, 64 are contemplated to expand. Thus, the bracket 10 of the present concept is configured to absorb this expansion during a cooking procedure.

As specifically shown in FIG. 8, the cooking appliance 60 includes a support frame 70 having a front portion 71 and a rear portion 73. The rear portion 73 of the support frame 70 includes first and second frame members 72, 74 which are connected by upper and lower cross members 76, 78, in the embodiment of FIG. 8. The front portion 71 of the support frame 70 includes first and second frame members 82, 84 that may be interconnected to one another by any number of cross members. In the embodiment shown in FIG. 8, the front portion 71 of the support frame 70 is interconnected with the rear portion 73 of the support frame 70 by upper and lower interconnecting supports 86, 88. It is contemplated that the front and rear portions 71, 73 of the support frame 70 may be interconnected by any number of interconnecting support members as necessary to support the upper and lower cooking vessels 62, 64 of the cooking appliance 60.

In the embodiment shown in FIG. 8, it is contemplated that a front plate 90 interconnects the upper and lower cooking vessels 62, 64 with the front portion 71 of the support frame 70. It is contemplated that this is a rigid coupling between the front plate 90 and the support frame 70. Thus, as the upper and lower cooking vessels 62, 64 expand from an at-rest condition to an expanded condition during a cooking procedure, and contract from the expanded condition to the at-rest condition as the heat dissipates from the cooking procedure, the movement of the upper and lower cooking vessels 62, 64 is directed towards the rear portions of the upper and lower cooking vessels 62, 64 given the rigid coupling between the front plate 90 and the front portion 71 of the support frame 70. Thus, the rear portions of the upper and lower cooking vessels 62, 64 are operably coupled to the rear portion 73 of the support frame 70 by a number of brackets 10 of the present concept, in order to absorb the expansion and contraction of the upper and lower cooking vessels 62, 64. Specifically, the upper and lower cooking vessels 62, 64 are spaced-apart from the rear portion 73 of the support frame 70 to define a spacing 92 therebetween. The brackets 10 span the spacing 92 to interconnect the upper and lower cooking vessels 62, 64 with the rear portion 73 of the support frame 70. Specifically, the outer surfaces 63, 65 of the upper and lower cooking vessels 62, 64 approach the rear portion 73 of the support frame 70 when the upper and lower cooking vessels 62, 64 moves from the at-rest condition to the expanded condition during a cooking procedure to close the spacing 92 therebetween.

As specifically shown in the magnified portion of FIG. 8, the bracket 10 interconnects the outer surface 63 of the upper cooking vessel 62 with the first frame member 72 of the rear portion 73 of the support frame 70. Specifically, the first mounting member 12 of the bracket 10 is operably coupled to the rear mounting plate 66 of the upper cooking vessel 62 at the upper and lower mounting apertures 16, 17. Similarly, the second mounting member 14 of the bracket 10 is operably coupled to an outer surface 72A of the first frame member 72 of the support frame 70 at upper and lower mounting apertures 18, 19. It is contemplated that the bracket 10 may be fastened to the rear mounting plate 66 and the first frame member 72 using fasteners mounted to the respective upper and lower mounting apertures 16, 17 and 18, 19. It is also contemplated that the bracket 10 may be welded to the rear mounting plate 66 and the first frame member 72 at the respective upper and lower mounting apertures 16, 17 and 18, 19. In the magnified portion of FIG. 8, upper and lower mounting apertures 67A and 67B are shown disposed through the rear mounting plate 66 of the upper cooking vessel 62 and are aligned with the upper and lower mounting apertures 16, 17 of the first mounting member 12 of the bracket 10. In this way, the associated upper and lower mounting apertures 67A, 67B and 16, 17 are aligned to receive a fastener therebetween to rigidly interconnect the bracket 10 with the upper cooking vessel 62. With the bracket 10 interconnecting the upper cooking vessel 62 to the support frame 70, the first and second connecting members 22, 24 are configured to flex in response to the upper cooking vessel 62 moving between the at-rest and expanded conditions. Thus, as the upper cooking vessel 62 moves from the at-rest condition to the expanded condition, the first mounting member 12 of the bracket 10 will move towards the second mounting member 14 of the bracket 10 as the bracket 10 moves from the at-rest position to the contracted position. Movement of the bracket 10 from the at-rest position to the contracted position is accounted for at the first and second connecting members 22, 24 moving from the at-rest condition to the loaded condition.

As noted above, with reference to FIGS. 1 and 2, the first and second connecting members 22, 24 are vertically spaced-apart a distance D to define the thermal break 26. The thermal break 26 is provided between the first and second mounting members 12, 14, to reduce thermal conductivity between the cooking appliance 60 and the support frame 70 thereof. In this way, the thermal break 26 provides a window positioned between the first and second mounting members 12, 14 of the bracket 10 to decrease the overall thermal bridge that would be present in a bracket without such a thermal break 26.

Figure 9:
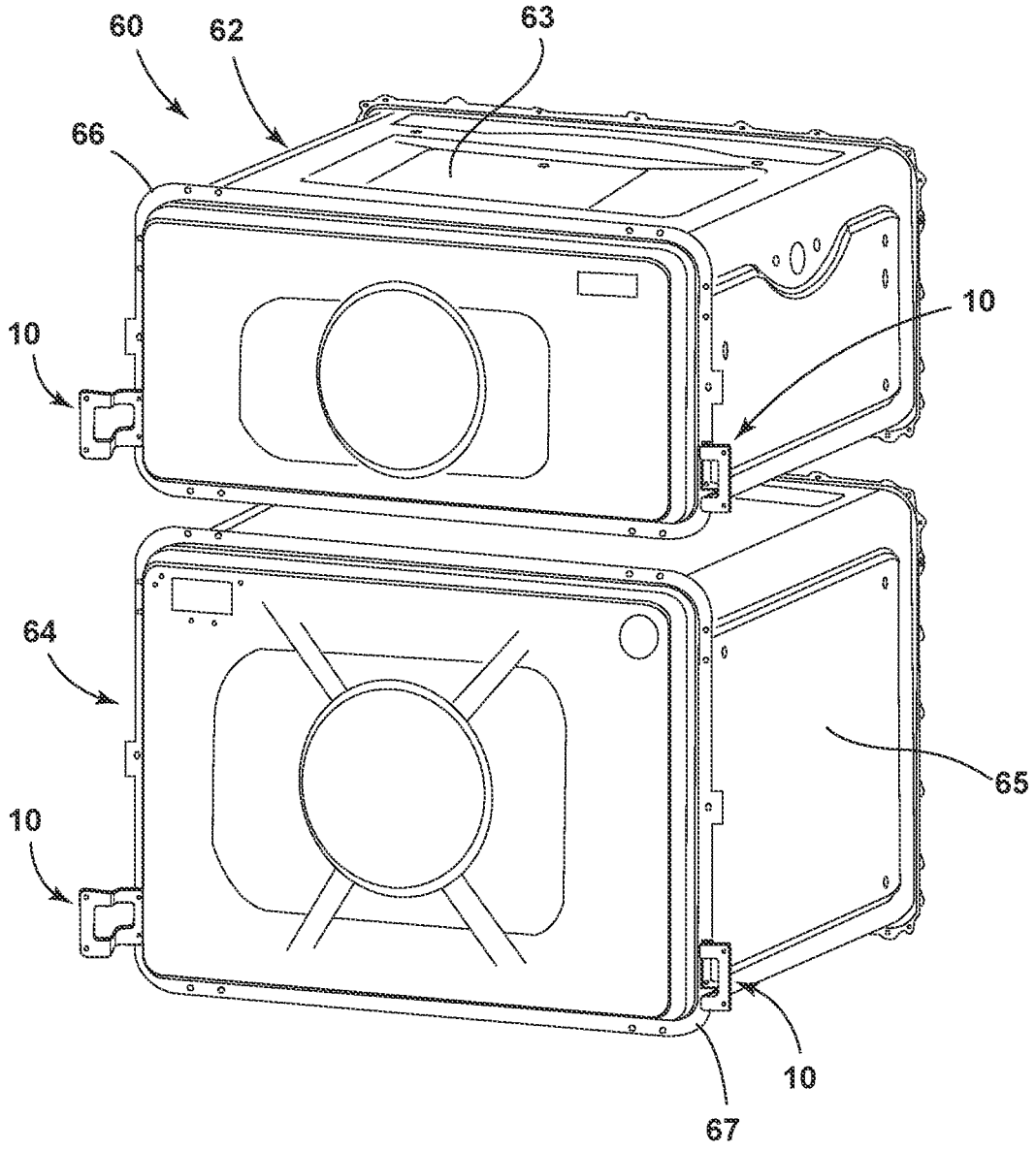
FIG. 9 is a rear top perspective view of the cooking appliance of FIG. 8.

Referring now to FIG. 9, the cooking appliance 60 is shown from a rear perspective view with the support frame 70 removed. In the view of FIG. 9, the upper cooking vessel 62 is shown as having first and second brackets 10 disposed on opposite sides of the rear mounting plate 66. Similarly, the lower cooking vessel 64 is shown as having first and second brackets 10 disposed on opposite sides of the rear mounting plate 67. Thus, multiple brackets can be used to couple cooking vessels to a support frame as needed to properly support the cooking vessels on the support frame.

According to another aspect of the present disclosure, a cooking appliance includes a support frame and a cooking vessel that is spaced-apart from the support frame to define a spacing therebetween. The cooking vessel is operable between at-rest and expanded conditions. An outer surface of the cooking vessel approaches the support frame when the cooking vessel moves from the at-rest condition to the expanded condition. A bracket interconnects the support frame and the cooking vessel. The bracket includes a first mounting member operably coupled to the cooking vessel and a second mounting member operably coupled to the support frame. At least one flexibly resilient connecting member interconnects the first and second mounting members and spans the spacing between the support frame and the cooking vessel.

According to another aspect, the at least one flexibly resilient connecting member is configured to flex in response to the cooking vessel moving between the at-rest and expanded conditions.

According to another aspect, the at least one flexibly resilient connecting member is operable between at-rest and loaded conditions, wherein the at least one flexibly resilient connecting member moves from the at-rest condition to the loaded condition as the cooking vessel moves from the at-rest condition to the expanded condition.

According to another aspect, the at least one flexibly resilient connecting member is a non-linear member and includes a first portion and a second portion with an intermediate portion disposed therebetween.

According to another aspect, the first portion and the second portion of the at least one flexibly resilient connecting member are connected to opposite ends of the intermediate portion at first and second deflection creases.

According to another aspect, the at least one flexibly resilient connecting member is configured to flex at the first and second deflection creases in response to the cooking vessel moving between the at-rest and expanded conditions.

According to another aspect, the at least one flexibly resilient connecting member includes first and second flexibly resilient connecting members that are vertically spaced-apart from one another to define a thermal break therebetween.

According to another aspect, the first mounting member moves towards the second mounting member when the at least one flexibly resilient connecting member moves from the at-rest condition to the loaded condition.

According to another aspect of the present disclosure, a bracket for a cooking appliance includes a first mounting member spaced-apart from a second mounting member to define a gap therebetween. A first connecting member spans the gap between the first and second mounting members. The first connecting member includes a first portion coupled to the first mounting member, second portion coupled to the second mounting member, and an intermediate portion disposed therebetween. The first and second portions of the first connecting member are coupled to opposite ends of the intermediate portion at first and second deflection creases, respectively. A second connecting member spans the gap between the first and second mounting members and includes a first portion that is coupled to the first mounting member, a second portion coupled to the second mounting member, and an intermediate portion disposed therebetween. The first and second portions of the second connecting member are coupled to opposite ends of the intermediate portion at first and second deflection creases, respectively.

According to another aspect, the first and second connecting members are spaced-apart from one another to define a thermal break between the first mounting member and the second mounting member.

According to another aspect, the bracket is operably between at-rest and contracted positions, wherein a length of the gap is greater when the bracket is in the at-rest position. The bracket is biased towards the at-rest position.

According to another aspect, the first and second connecting members are configured to flex at the first and second deflection creases in response to the bracket moving between the at-rest and contracted positions.

According to another aspect, the first and second connecting members include a Z-shaped configuration.

According to yet another aspect of the present disclosure, a bracket for a cooking appliance includes a first mounting member and a second mounting member spaced-apart from the first mounting member to define a gap having a length disposed therebetween. At least one connecting member interconnects the first and second mounting members. The at least one connecting member includes at least one deflection crease and is operable between at-rest and loaded conditions. The length of the gap decreases as the at least one connecting member moves from the at-rest condition to the loaded condition.

According to another aspect, the first mounting member moves towards the second mounting member when the at least one connecting member moves from the at-rest condition to the loaded condition.

According to another aspect, the at least one connecting member includes first and second deflection creases.

According to another aspect, the at least one flexibly resilient connecting member is configured to inwardly flex at the first and second deflection creases.

According to another aspect, the at least one flexibly resilient connecting member includes first and second flexibly resilient connecting members that are spaced-apart from one another.

According to another aspect, the first and second connecting members include a Z-shaped configuration.

According to another aspect, the first and second mounting members each include generally planar body portions having mounting apertures disposed therethrough.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooking appliance, comprising:

a support frame having front and rear portions spaced-apart from one another and interconnected by one or more interconnecting supports, wherein the front portion of the support frame includes first and second upright frame members spaced-apart from one another, wherein the rear portion of the support frame includes first and second upright frame members spaced-apart from one another and interconnected to one another by one or more cross members;

a cooking vessel received between the front and rear portions of the support frame and supported thereby, the cooking vessel having a front plate coupled to the first and second upright frame members of the front portion of the support frame, and a rear plate spaced-apart from the first and second upright frame members of the rear portion of the support frame to define a spacing therebetween, wherein the cooking vessel is operable between at-rest and expanded conditions, and further wherein the rear plate of the cooking vessel approaches the rear portion of the support frame when the cooking vessel moves from the at-rest condition to the expanded condition; and at least one bracket interconnecting the rear portion of the support frame and the rear plate of the cooking vessel, wherein the at least one bracket includes a first mounting member directly coupled to the rear plate of the cooking vessel, a second mounting member directly coupled to one of the first and second upright frame members of the rear portion of the support frame and at least one flexibly resilient connecting member interconnecting the first and second mounting members, wherein the at least one flexibly resilient connecting member spans the spacing between the rear portion of the support frame and the rear plate of the cooking vessel, and further wherein the at least one flexibly resilient connecting member includes a first portion and a second portion with an intermediate portion disposed therebetween such that an angle formed between the first portion and the intermediate portion is an acute angle, and an angle formed between the second portion and the intermediate portion is an acute angle.

2. The cooking appliance of claim 1, wherein the at least one flexibly resilient connecting member is configured to flex in response to the cooking vessel moving between the at-rest and expanded conditions.

3. The cooking appliance of claim 1, wherein the at least one flexibly resilient connecting member is operable between at-rest and loaded conditions, and further wherein the at least one flexibly resilient connecting member moves from the at-rest condition to the loaded condition as the cooking vessel moves from the at-rest condition to the expanded condition.

4. The cooking appliance of claim 1, wherein the first portion and the second portion of the at least one flexibly resilient connecting member are connected to opposite ends of the intermediate portion.

5. The cooking appliance of claim 4, wherein the at least one flexibly resilient connecting member is configured to flex at the acute angles in response to the cooking vessel moving between the at-rest and expanded conditions.

6. The cooking appliance of claim 1, wherein the at least one flexibly resilient connecting member includes first and second flexibly resilient connecting members that are vertically spaced-apart from one another to define a thermal break therebetween.

7. The cooking appliance of claim 3, wherein the first mounting member moves towards the second mounting member when the at least one flexibly resilient connecting member moves from the at-rest condition to the loaded condition.

8. The cooking appliance of claim 1, wherein the at least one flexibly resilient connecting member includes:

a first connecting member spanning a gap between the first and second mounting members; and a second connecting member spanning the gap between the first and second mounting members.

9. The cooking appliance of claim 8, wherein the at least one bracket is operably between at-rest and contracted positions, wherein a length of the gap is greater when the at least one bracket is in the at-rest position, and further wherein the at least one bracket is biased towards the at-rest position.

10. The cooking appliance of claim 9, wherein the first and second connecting members are configured to flex at the first and second deflection creases in response to the at least one bracket moving between the at-rest and contracted positions.

11. The cooking appliance of claim 8, wherein the first and second mounting members each include generally planar body portions having mounting apertures disposed therethrough.

12. The cooking appliance of claim 1, wherein the at least one bracket includes a plurality of brackets, wherein first and second brackets of the plurality of brackets are coupled between the first upright frame member of the rear portion of the support frame and the rear plate of the cooking vessel, and further wherein third and fourth brackets of the plurality of brackets are coupled between the second upright frame member of the rear portion of the support frame and the rear plate of the cooking vessel.

13. The cooking appliance of claim 12, wherein the at least one flexibly resilient connecting member of each bracket of the plurality of brackets includes:

a first connecting member spanning a gap between the first and second mounting members; and a second connecting member spanning the gap between the first and second mounting members.

* * * * *